US007877879B2

(12) United States Patent
Nakasuka

(10) Patent No.: US 7,877,879 B2
(45) Date of Patent: Feb. 1, 2011

(54) RAZOR

(75) Inventor: Hiroyuki Nakasuka, Seki (JP)

(73) Assignee: Kai R&D Center Co., Ltd., Gifu-ken (JP)

( * ) Notice: Subject to any disclaimer, the term of this patent is extended or adjusted under 35 U.S.C. 154(b) by 314 days.

(21) Appl. No.: 11/991,269

(22) PCT Filed: Aug. 29, 2006

(86) PCT No.: PCT/JP2006/316915

§ 371 (c)(1),
(2), (4) Date: Feb. 29, 2008

(87) PCT Pub. No.: WO2007/029553

PCT Pub. Date: Mar. 15, 2007

(65) Prior Publication Data

US 2008/0250646 A1 Oct. 16, 2008

(30) Foreign Application Priority Data

Sep. 9, 2005 (JP) ..... 2005-262484

(51) Int. Cl.
*B26B 19/40* (2006.01)

(52) U.S. Cl. ..... 30/41; 30/50

(58) Field of Classification Search ..... 30/32, 30/34.05, 41, 50, 537, 538
See application file for complete search history.

(56) References Cited

U.S. PATENT DOCUMENTS

| | | | | |
|---|---|---|---|---|
| 2,677,883 | A | 5/1954 | Schallgruber | |
| 4,074,429 | A | 2/1978 | Roberts | |
| 4,709,477 | A | 12/1987 | Ferraro | |
| 4,774,765 | A | 10/1988 | Ferraro | |
| 4,944,090 | A | 7/1990 | Sumnall | |
| 5,134,775 | A | 8/1992 | Althaus et al. | |
| 6,145,201 | A * | 11/2000 | Andrews | 30/50 |
| 6,295,734 | B1 * | 10/2001 | Gilder et al. | 30/50 |
| 6,655,028 | B2 * | 12/2003 | Coffin | 30/41 |
| 7,127,817 | B2 * | 10/2006 | Orloff et al. | 30/41 |
| 7,367,125 | B2 * | 5/2008 | Aviza | 30/34.05 |
| 7,540,088 | B2 * | 6/2009 | Takeshita | 30/34.2 |
| 2003/0200660 | A1 * | 10/2003 | Pennella et al. | 30/47 |
| 2005/0126007 | A1 | 6/2005 | Aviza | |

(Continued)

FOREIGN PATENT DOCUMENTS

DE 334947 C 3/1921

(Continued)

OTHER PUBLICATIONS

International Search Report dated Nov. 24, 2006 in corresponding International Application No. PCT/JP2006/316915.

(Continued)

*Primary Examiner*—Hwei-Siu C Payer
(74) *Attorney, Agent, or Firm*—Posz Law Group, PLC

(57) ABSTRACT

In a razor including a razor head 16 having blade bodies 19, a shaving aid member 27 is provided on the razor head 16. The shaving aid member 27 reciprocates between an initial position and an end position, which is separate from the initial position by a predetermined range. The shaving aid member 27 is urged toward the initial position by elastic bodies 31.

10 Claims, 5 Drawing Sheets

U.S. PATENT DOCUMENTS

| | | | | |
|---|---|---|---|---|
| 2006/0080837 | A1* | 4/2006 | Johnson et al. | 30/50 |
| 2008/0209734 | A1* | 9/2008 | Nicoll | 30/41 |
| 2009/0307908 | A1* | 12/2009 | Nakasuka | 30/41 |

FOREIGN PATENT DOCUMENTS

| | | |
|---|---|---|
| JP | Y2-62-28293 | 7/1987 |
| JP | A-63-119794 | 5/1988 |
| JP | U-7-3575 | 6/1993 |
| JP | A-6-500937 | 2/1994 |
| JP | U-7-39761 | 7/1995 |
| JP | A-10-500888 | 1/1998 |
| JP | A-2001-038072 | 2/2001 |
| JP | WO 01/39937 | 6/2001 |
| JP | A-2003-515401 | 5/2003 |
| WO | WO 92/05927 | 4/1992 |
| WO | WO 96/29183 | 9/1996 |
| WO | WO 2006/044394 A | 4/2006 |

OTHER PUBLICATIONS

Notification of Transmittal of Translation of the International Preliminary Report on Patentability dated Mar. 20, 2008 in corresponding PCT Application No. PCT/JP2006/316915.

Extended European Search Report mailed on Sep. 14, 2009 issued from the European Patent Office in the corresponding European patent application No. 06821794.2-2313.

* cited by examiner

RAZOR

CROSS REFERENCE TO APPLICATIONS

This application is a U.S. national stage application of PCT/JP2006/316915 filed on Aug. 29, 2006, which is based on Japanese Patent Application No. 2005-262484 filed on Sep. 9, 2005, the disclosures of which are incorporated herein by reference.

This application is related to U.S. application Ser. No. 11/991,244, entitled OSCILLATING RAZOR, filed on Feb. 29, 2008, which is a U.S. national stage application of PCT Application No. PCT/JP2006/316914 filed on Aug. 29, 2006.

FIELD OF THE INVENTION

The present invention relates to a razor in which a razor head having blade bodies is provided with a shaving aid.

BACKGROUND OF THE INVENTION

In a razor disclosed in Patent Document 1, a shaving aid is embedded in a top plate of a razor head and exposed. Patent Document 1: Japanese Laid-Open Patent Publication No. 2001-38072

SUMMARY OF THE INVENTION

However, in the Patent Document 1, since the shaving aid is fixed on the top plate of the razor head, when the razor head is placed on a skin surface, the shaving aid might press the skin surface with force that is more than necessary, and might deteriorate the feeling upon use.

The objective of the present invention is to improve the feeling upon use of a razor having a shaving aid.

According to the present invention, a razor including a razor head having a blade body is provided. In the razor, the razor head is provided with a shaving aid member, which reciprocates between an initial position and an end position, which is apart from the initial position by a predetermined range, the shaving aid member is urged toward the initial position by an elastic body. Thus, the razor with the shaving aid provides improved feeling upon use.

The shaving aid member is preferably swingable between the initial position and the end position.

The shaving aid member is preferably supported to be swingable with respect to the razor head about an axis extending along an extending direction of a cutting edge of the blade body.

The shaving aid member preferably includes a shaving aid and a base member on which the shaving aid is mounted. The base member includes arm portions provided on both sides of the razor head. The base member is supported by the razor head with the arm portions.

The razor head preferably includes an assembly member formed by a blade base and a top plate. The blade body is provided between the blade base and the top plate. The top plate is provided with a guard, which faces the cutting edge of the blade body.

The shaving aid member is preferably arranged on the assembly member so as to be located opposite to the guard.

The blade body is preferably exposed outward from the assembly member. When the razor head is arranged at the initial position, the shaving aid of the shaving aid member preferably protrudes outward from a skin contact surface, which connects the guard and the top plate.

The elastic body is preferably a leaf spring provided integrally with the shaving aid member. The leaf spring is preferably supported by the razor head to urge the shaving aid member toward the initial position.

The arm portions preferably protrude from both sides of the base member. The elastic body is preferably leaf springs provided integrally with the arm portions.

BRIEF DESCRIPTION OF THE DRAWINGS

FIG. 1(*b*) is a perspective view of the oscillating razor as viewed from the back;

FIG. 2(*b*) is a side view of the same;

FIG. 2(*c*) is a cross-sectional view of the same as viewed from the top;

FIG. 3(*b*) is a back view of the same;

FIG. 3(*c*) is a side view of the same;

FIG. 4(*b*) is a back view of the same;

FIG. 4(*c*) is a partial side view of the same;

FIG. 5(*b*) is a back view of the same;

FIG. 6(*b*) and FIG. 6(*c*) are side views illustrating a state where the shaving aid member is at a pivoted position;

FIG. 7(*b*) is a cross-sectional view illustrating the pusher as viewed from the top; and FIG. 7(*c*) is a cross-sectional view illustrating the pusher as viewed from the side.

DETAILED DESCRIPTION OF THE PREFERRED EMBODIMENTS

An oscillating razor according to one embodiment of the present invention will now be described with reference to the drawings.

Figure 1:
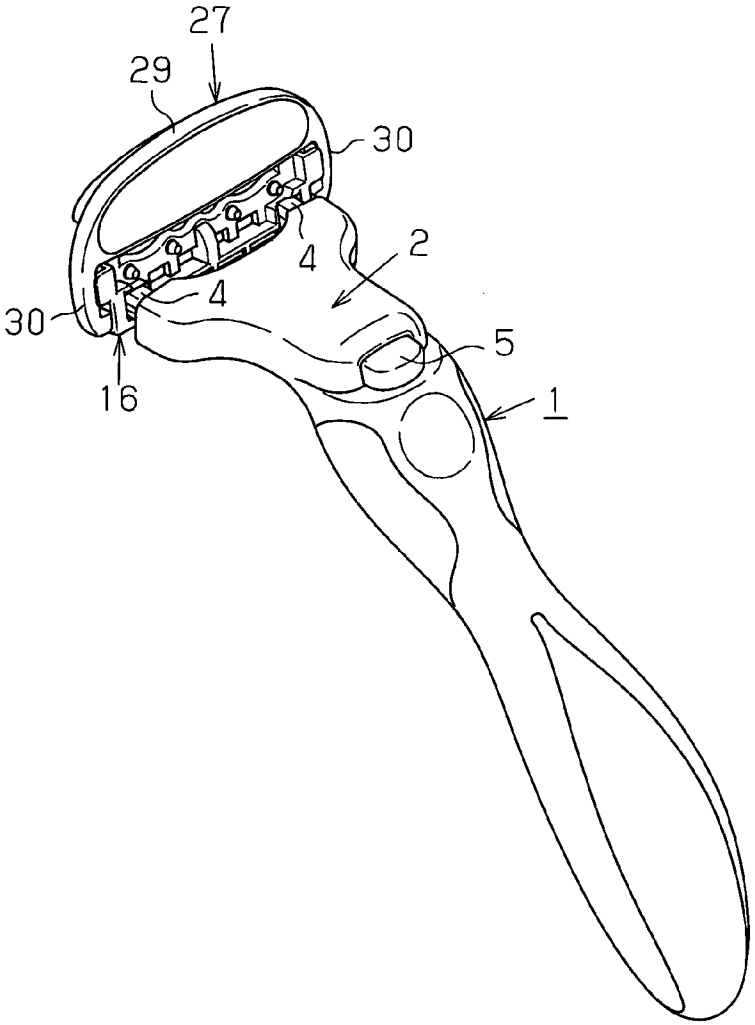
FIG. 1(*a*) is a perspective view illustrating an oscillating razor according to a preferred embodiment as viewed from the front.
Figure 1:
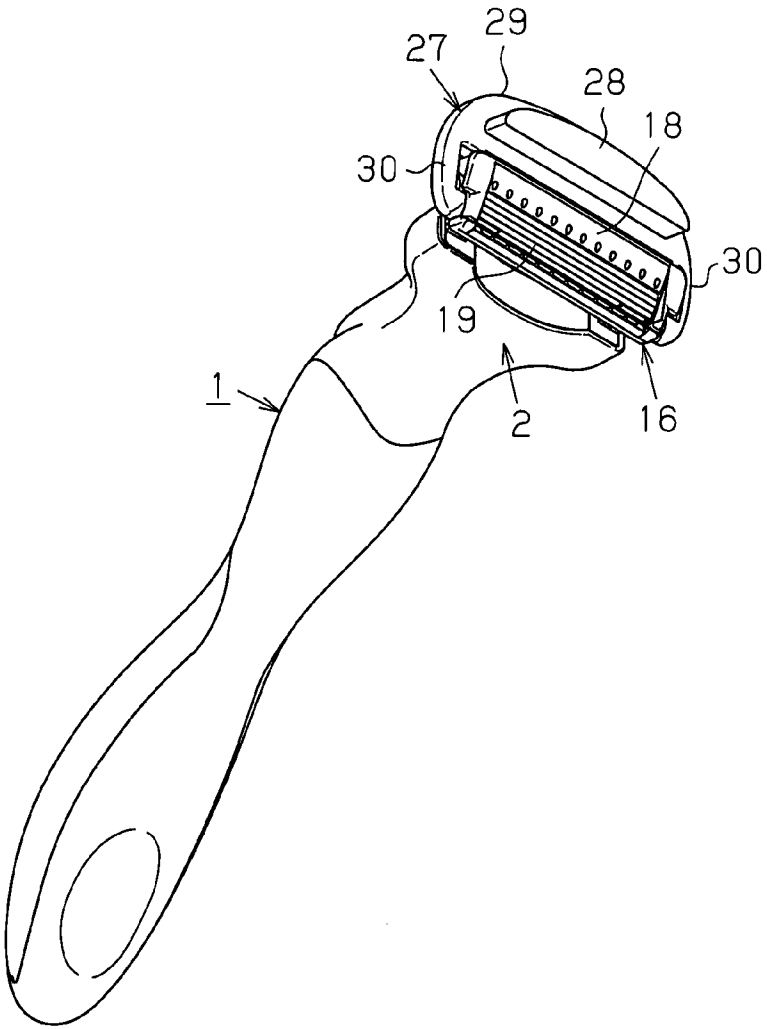
Figure 2C:
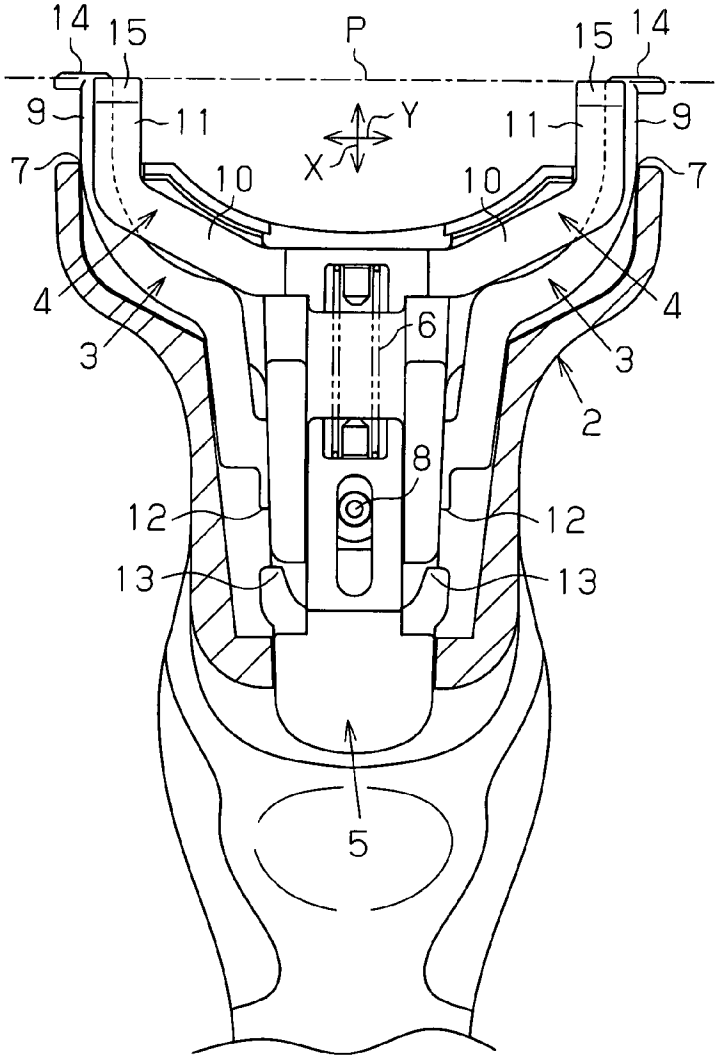
FIG. 2(*a*) is a plan view illustrating the head portion of the holder of the oscillating razor.
Figure 2A:
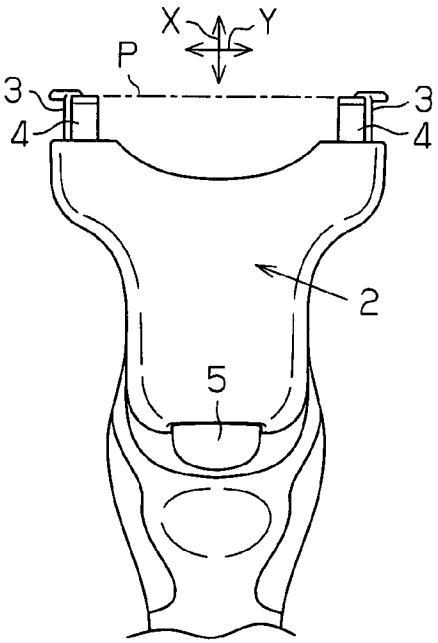
Figure 2B:
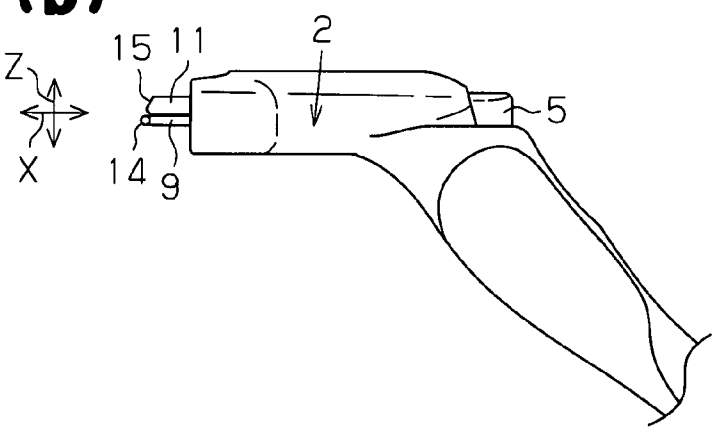

A holder 1 shown in FIGS. 1(*a*), 1(*b*), 2(*a*), and 2(*b*) is molded out of plastic. As shown in FIG. 2(*c*), a head portion 2 of the holder 1 incorporates a pair of metal support arms 3, a bifurcated plastic pusher 4, a plastic operating knob 5, and a metal compression coil spring 6. An opening 7 is formed at each end of the front end of the head portion 2. The support arms 3 are supported at their proximal ends to swing about a support shaft 8. Each support arm 3 includes an outer arm portion 9 (distal end portion), which extends from the proximal end toward the front side of the head portion 2 and protrudes outside from the corresponding opening 7 of the head portion 2. The outer arm portions 9 move in a Y-direction as the support arms 3 swing.

The pusher 4 is arranged between the support arms 3 in the vicinity of the front end of the head portion 2. The pusher 4 is supported at its proximal end to be movable in an X-direction with respect to the head portion 2. The pusher 4 includes inner arm portions 10, which extend from its proximal end toward the support arms 3, and outer arm portions 11 (distal end portions), which extend forward from the inner arm portions 10 and protrude outside from the openings 7 of the head portion 2.

The operating knob 5 is supported at the rear of the head portion 2 to be movable in the X-direction, and protrudes outside of the head portion 2 from the rear end of the head portion 2. The compression coil spring 6 (elastic body) is located between the proximal end of the pusher 4 and the operating knob 5. The compression coil spring 6 urges the proximal end of the pusher 4 forward so that the pusher 4 is pressed against the front end of the head portion 2 while urging the operating knob 5 rearward to protrude outside of the head portion 2, which is a non-operation state. Meanwhile, the compression coil spring 6 urges the support arms 3 to be fully opened with the operating knob 5.

An abutment portion 12 is formed at the proximal end of each support arm 3. The operating knob 5 includes a depression portion 13 on either end, each facing the corresponding abutment portion 12. When the operating knob 5 is pressed forward against the elastic force of the compression coil spring 6, the depression portions 13 of the operating knob 5 press the abutment portions 12 of the support arms 3, and the outer arm portions 9 of the support arms 3 approach each other from the fully opened state. When an user removes a hand from the operating knob 5, the urging force of the compression coil spring 6 returns the operating knob 5 to the non-operation state, and the outer arm portions 9 of the support arms 3 return to the fully opened state.

Each of the outer arm portions 9 of the support arms 3 includes a hooked end portion 14. The outer arm portions 11 of the pusher 4 include contact end portions 15. The outer arm portions 9 of the support arms 3 and the outer arm portions 11 of the pusher 4 are arranged adjacent to each other along an up-and-down direction, that is, a Z-direction at the openings 7 of the head portion 2 of the holder 1 and outside the front end of the head portion 2.

In the razor head 16 as shown in FIGS. 1(*a*), 1(*b*), 3(*a*), 3(*b*), 3(*c*), 5(*a*), and 5(*b*), blade bodies 19 (four in this embodiment) are sandwiched between assembly members, which are a blade base 17 and a top plate 18. Cutting edges 19*a* of the blade bodies 19 are exposed to the front side between arm portions 18*a*, which protrude from both sides of the top plate 18, and the cutting edges 19*a* of the blade bodies 19 face a guard 17*a*, which is formed on the blade base 17. A shaving aid is integrally formed on the surface of the guard 17*a* by insert injection molding.

Figure 7A:
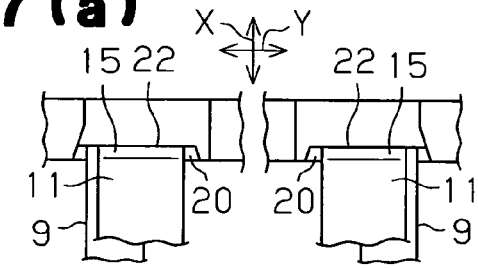
FIG. 7 (*a*) is a partial plan view of the oscillating razor illustrating a support structure of the razor head with respect to the support arms and a contact structure of the pusher with respect to the razor head.
Figure 7B:
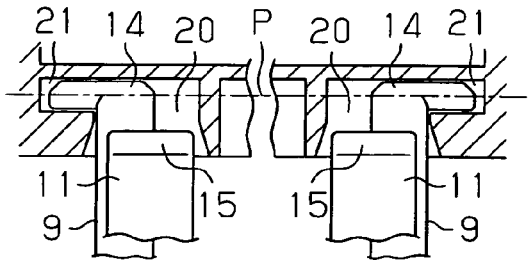
Figure 7C:
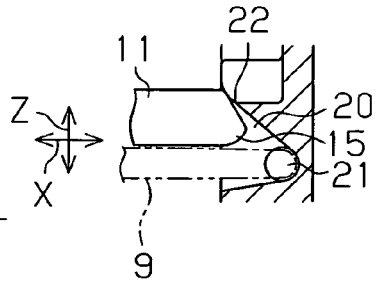

A supported bore 21 and a reception portion 22 are formed adjacent to each other in each of recesses 20, which are formed on both ends of the blade base 17 as shown in FIGS. 7(*a*), 7(*b*), and 7(*c*). At both ends of the razor head 16, walls 23, 24 project from the blade base 17 and the top plate 18, respectively. A spring chamber 25 is formed between the walls 23, 24, and is located closer to the guard 17*a* than the walls 23, 24. A support shaft 26 is formed on each side surface of the blade base 17. The support shafts 26 are arranged on a pivot axis 26*a* of the blade base 17 along the Y-direction (extending direction of the cutting edges 19*a*).

In a shaving aid member 27 shown in FIGS. 1(*a*), 1(*b*), 4(*a*), 4(*b*), 4(*c*), 5(*a*), and 5(*b*), a shaving aid 28 is fitted in a recessed portion 28*a* formed in the surface of a plastic base member 29. An arm portion 30 is formed on each side of the base member 29. A support bore 32 is formed in the inner side surface of and at the distal end of each arm portion 30, and a cantilever type leaf spring 31 is formed integrally with each arm portion 30 to curve toward the shaving aid 28 from the vicinity of the associated support bore 32.

The leaf springs 31 may extend linearly. One of the leaf springs 31 on the arm portions 30 may be omitted. The dimension of the base member 29 along the Y-direction is approximately 50 mm. The dimension of the shaving aid 28 along the Y-direction is approximately 38 mm. The width of the surface of the shaving aid 28 in a direction perpendicular to the Y-direction is the greatest at the center portion, and is approximately 8 mm. The shaving aid 28 protrudes from the surface of the base member 29 by a height of approximately 5 mm. The shaving aid 28 is, for example, a porous body such as a sponge impregnated with one of a soap, a shaving cream, a lubricating agent, a beard softener, a milky lotion, a medical agent, a hair growth inhibitor, a hair remover, an after shave lotion, a moisturizing agent, and a hemostatic agent or a compound of these.

Figure 5A:
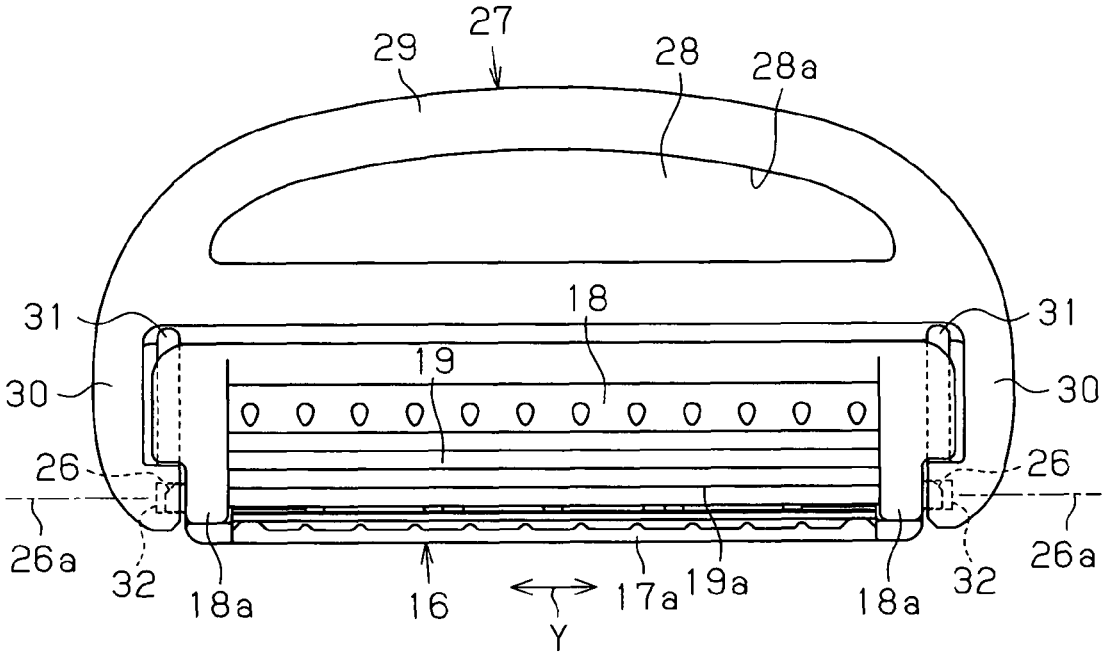
FIG. 5(*a*) is a front view illustrating the razor head of the oscillating razor supporting the shaving aid member.
Figure 5B:
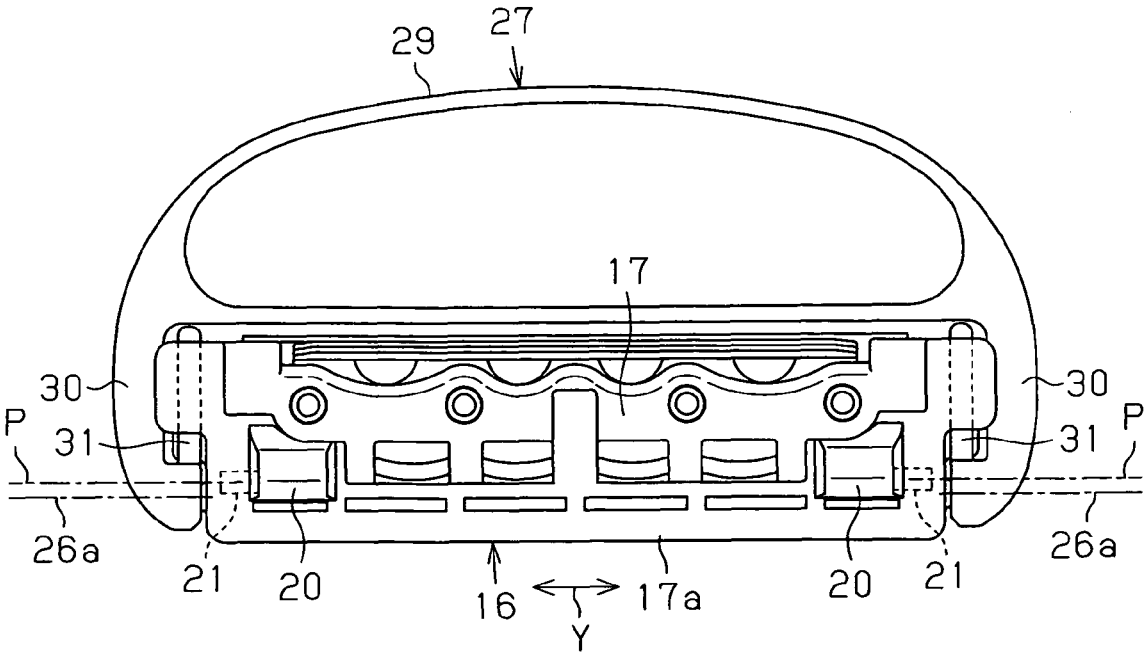

As shown in FIGS. 5(*a*) and 5(*b*), the base member 29 of the shaving aid member 27 and the shaving aid 28 mounted on the base member 29 are located opposite to the guard 17*a* with respect to the razor head 16. The arm portions 30 of the base member 29 contact the outer sides of the end portions of the razor head 16 so that the arm portions 30 and the razor head 16 are arranged next to one another in the Y-direction. At this time, the support shafts 26 of the razor head 16 are inserted in the support bores 32 of the arm portions 30, and the leaf springs 31 of the arm portions 30 are inserted in the spring chambers 25 of the razor head 16. Thus, the shaving aid member 27 is supported to swing with respect to the razor head 16 about the pivot axis 26*a* of the support shafts 26.

Figure 6A:
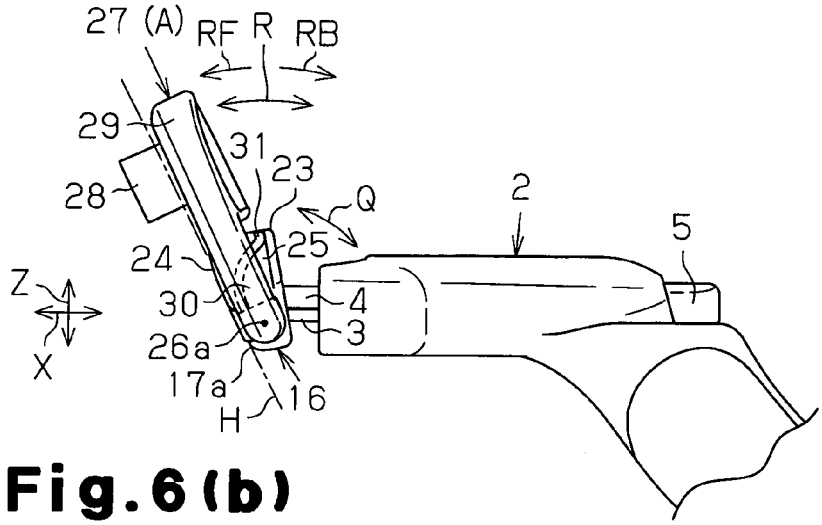
FIG. 6(*a*) is a side view illustrating the razor head supported on the head portion of the holder of the oscillating razor in a state where the shaving aid member is at an initial position.
Figure 6B:
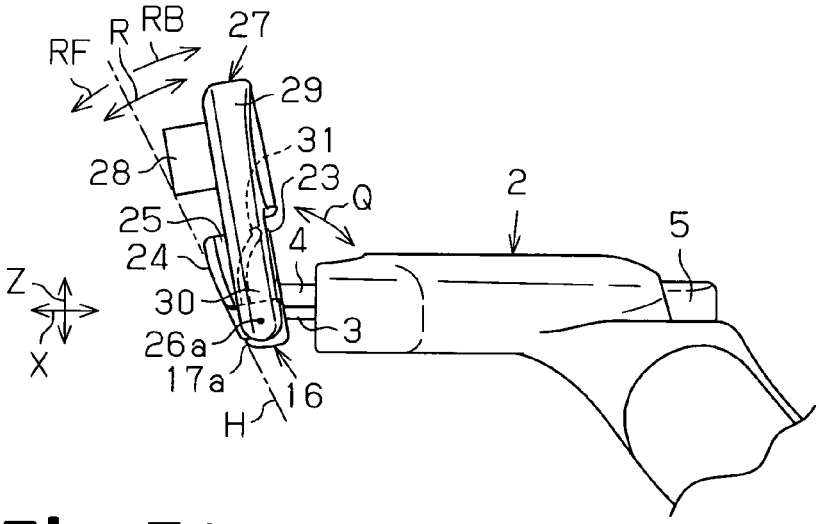
Figure 6C:
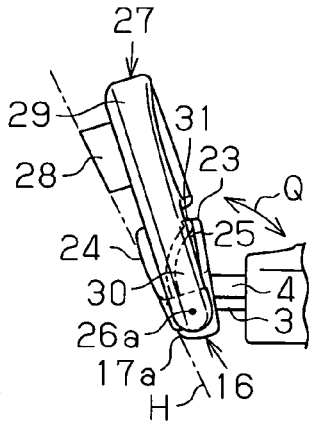

In a state where the support arms 3 are brought closer to each other, the outer arm portions 9 are inserted in the recesses 20 of the blade base 17. After that, when the support arms 3 are fully opened, the razor head 16 is in an attachment state as shown in FIG. 6(*a*) where the razor head 16 is oscillatably supported by the head portion 2 of the holder 1. In this attachment state, as shown in FIGS. 7(*a*), 7(*b*), 7(*c*), the hooked end portions 14 of the outer arm portions 9 are inserted in the supported bores 21 of the recesses 20 so that the razor head 16 is supported by the holder 1. Meanwhile, the contact end portions 15 of the outer arm portions 11 of the pusher 4 abut against the reception portions 22 of the recesses 20. Thus, the razor head 16 swings in the oscillating direction Q together with the shaving aid member 27 about a pivot axis P, which connects the hooked end portions 14.

Figure 3A:
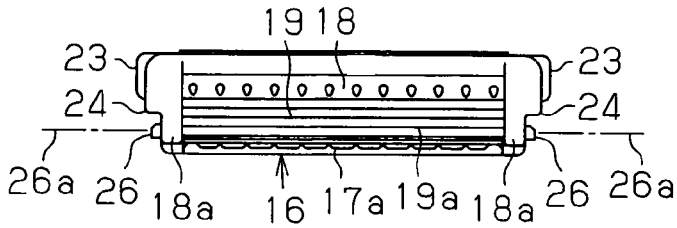
FIG. 3(*a*) is a front view illustrating the razor head of the oscillating razor.
Figure 3B:
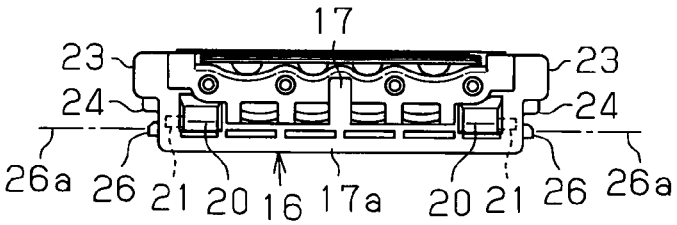
Figure 3C:
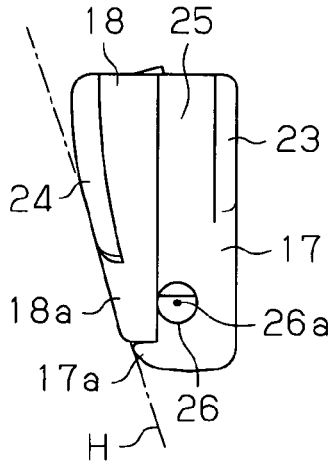
Figure 4A:
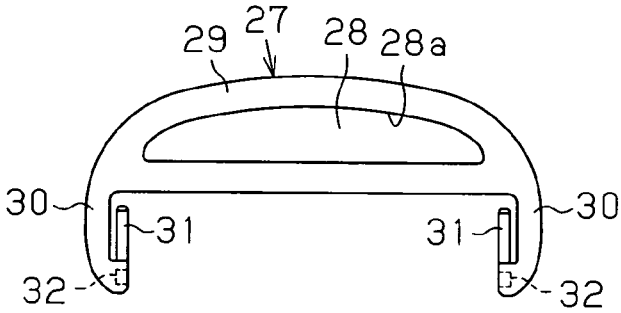
FIG. 4(*a*) is a front view illustrating the shaving aid member of the oscillating razor.
Figure 4B:
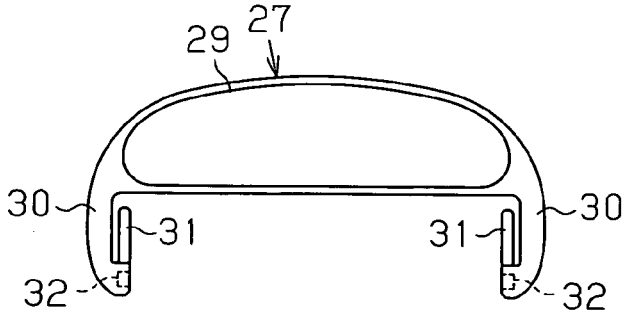
Figure 4C:
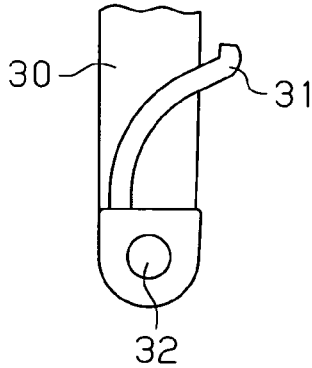

As shown in FIGS. 3(*a*), 3(*b*), 3(*c*), 5(*a*), 5(*b*) and 6(*a*), the pivot axis 26*a* of the shaving aid member 27 with respect to the razor head 16 is closer to the guard 17*a* than the top plate 18, and is closer to the guard 17*a* than the pivot axis P. Also, the pivot axis 26*a* is at the back of a skin contact surface H, which passes through the upper surface of the guard 17*a* of the blade base 17 and the upper surface of the top plate 18, is closer to the top plate 18 than the guard 17*a*, and is located in the vicinity of the cutting edge 19*a* of the blade body 19 that is the closest to the guard 17*a*.

As shown in FIG. 6(*a*), in a state where the leaf springs 31 of the arm portions 30 of the base member 29 are supported by the walls 23 of the blade base 17 in the spring chambers 25, the shaving aid member 27 is urged by the leaf springs 31 from the back to the front of the razor head 16, that is, in a front direction RF of a reciprocating direction R (RF, RB), and the shaving aid member 27 is stopped at a position where the arm portions 30 are aligned with the walls 24 of the top plate 18. This stop position is referred to as an initial position A. At the initial position A, the shaving aid 28 protrudes forward from the skin contact surface H.

As shown in FIG. 6(*b*), during use, the shaving aid member 27 is pivoted from the initial position A against the elastic force of the leaf springs 31. The shaving aid member 27 is pivoted from the front to the back of the razor head 16, that is, in a rear direction RB, and is stopped at a position where the arm portions 30 contact the walls 23 of the blade base 17. Thus, the shaving aid member 27 swings with respect to the razor head 16 within a predetermined swinging angular range at which the shaving aid member 27 contacts the walls 24, 23. In other words, the shaving aid member 27 reciprocates between the initial position A and an end position, which is separate from the initial position A by a predetermined range. The swinging angular range of the shaving aid member 27 is set to 0 to 45°, and is preferably set to 0 to 30°.

Since the shaving aid member 27 moves from the initial position A against the elastic force of the elastic bodies 31 by the predetermined swinging angular range, when the razor head 16 and the shaving aid member 27 are placed on a skin surface, the shaving aid member 27 is placed on the skin surface with an appropriate elastic force. In particular, when the skin surface is uneven, the shaving aid member 27 follows the uneven skin surface.

The shaving aid member 27 is supported to be swingable with respect to the razor head 16 within a predetermined range about the pivot axis 26*a*, which extends along the extending direction Y of the cutting edges 19*a* of the blade bodies 19. Thus, when the razor head 16 and the shaving aid member 27 are placed on the skin surface, the shaving aid member 27 is placed on the skin surface uniformly.

When the shaving aid 28 is consumed by use, and the height from the surface of the base member 29 is reduced, the entire surface of the shaving aid 28 is placed on the skin surface as shown in FIG. 6(*c*). When the shaving aid 28 is reduced to the vicinity of the surface of the base member 29, for example, when part of the surface of the shaving aid 28 has reached the surface of the base member 29, it provides an indication of the need for replacing the razor head 16 and the shaving aid member 27.

The elastic force of the compression coil spring 6 applied to the pusher 4, which presses the hooked end portions 14 of the outer arm portions 9 against the razor head 16, and the elastic force of the leaf springs 31 applied to the shaving aid member 27 can be set in various manners. For example, the elastic force of the compression coil spring 6 is set greater than the elastic force of the leaf springs 31. Thus, when the razor head 16 and the shaving aid member 27 are placed on the skin surface, the shaving aid member 27 starts to swing from the initial position A with respect to the razor head 16, and after the shaving aid member 27 abuts against the walls 23, the razor head 16 swings in the oscillating direction Q together with the shaving aid member 27.

Furthermore, the razor head 16 is removed from the head portion 2 of the holder 1 by removing the outer arm portions 9 from recesses 20 of the blade base 17 in a state where the support arms 3 are brought closer to each other. In addition, the support arms 3 do not close immediately after the operating knob 5 is pressed. Instead, the support arms 3 close when the operating knob 5 is depressed by a predetermined amount to prevent the razor head 16 from being detached from the head portion 2 of the holder 1 as the operating knob 5 is inadvertently pressed.

The shaving aid member 27 includes the base member 29 on which the shaving aid 28 is mounted. The base member 29 has the arm portions 30, which are arranged next to both sides of the razor head 16 in the extending direction Y of the cutting edges 19*a* of the blade bodies 19. The base member 29 is supported by the razor head 16 with pivot center portions 26, 32 with the arm portions 30. Thus, the shaving aid member 27 having the shaving aid 28 is compactly supported by the razor head 16.

In the preferred embodiment, the blade bodies 19 are provided between the blade base 17 and the top plate 18 to be exposed to the front side. When the shaving aid member 27 is arranged at the initial position A, the shaving aid 28 protrudes outward from the skin contact surface H, which connects the guard 17*a* and the top plate 18. According to the invention of claim 8, when the razor head 16 and the shaving aid member 27 are placed on the skin surface, the blade bodies 19 of the razor head 16 are placed on the skin surface after the shaving aid 28 contacts the skin surface. Thus, although the shaving aid 28 is reduced by use, the shaving aid 28 is reliably brought into contact with the skin surface.

The razor may be configured as follows besides the preferred embodiment.

The base member 29 of the shaving aid member 27 and the blade base 17 or the top plate 18 of the razor head 16 may be integrally formed and coupled to each other with a coupling portion. The coupling portion may be the pivot center portion of the shaving aid member 27 with respect to the razor head 16.

In a razor in which the razor head 16 is provided integrally with the head portion 2 of the holder 1, the shaving aid member 27 may be pivotably supported by the razor head 16.

In the preferred embodiment, the shaving aid member 27 is arranged opposite to the guard 17*a* with respect to the razor head 16. However, the shaving aid member may be arranged next to the guard 17*a* on the same side with respect to the razor head 16, or may be arranged on both ends in the Y-direction.

The shaving aid member 27 may be pivotably supported by the holder 1.

The shaving aid member 27 may be detachable from the razor head 16 to be replaced. The shaving aid member may be supported to be movable in parallel with the razor head.

The leaf springs 31 may be formed integrally with the blade base 17 or the top plate 18 on both ends of the razor head 16 such that the shaving aid member 27 is urged by the leaf springs 31. Alternatively, one leaf spring 31 may be integrally formed at the central portion of the base member 29 of the shaving aid member 27 or at the central portion of the blade base 17 or the top plate 18 of the razor head 16 such that the shaving aid member 27 is urged by the leaf spring 31.

The shaving aid 28 may be solid, liquid, or semi-liquid. In the case where the shaving aid 28 is solid, the shaving aid 28 is attached to the base member 29 as it is. In the case where the shaving aid 28 is liquid or semi-liquid, a soft or hard porous body, for example, a sponge, a pumice stone, and a porous body such as polytetrafluoroethylene having fabric construction impregnated with the shaving aid 28 may be attached to the base member 29. These porous bodies are preferably capable of maintaining their shape. The bore diameter of the porous body may be set to various values, but is preferably 0.01 to 50 μm.

The shaving aid 28 may be provided integrally with the base member 29 by insert injection molding. Alternatively, after preparing the solid shaving aid 28 or the above mentioned porous body separately from the base member 29, the solid shaving aid 28 or the porous body may be attached to the base member 29.

The shaving aid 28 may be provided on the outer circumference of a roller, which is rotatably supported by the base member 29 of the shaving aid member 27.

The razor head 16 and the shaving aid member 27 may be covered with a cap to protect the blade bodies 19 and the shaving aid 28.

The oscillating razor of the preferred embodiment is mainly used for shaving the hair of arms and legs but may be used for shaving facial hair.

The invention claimed is:

1. A razor including:

a holder;

a razor head having a blade body, wherein the razor head is supported oscillatably by the holder about a first pivot axis, a guard facing the blade body; and a shaving aid member provided on the razor head, wherein the shaving aid member reciprocates between an initial position and an end position, which is apart from the initial position by a predetermined range, and the shaving aid member being urged toward the initial position by an elastic body, wherein the blade body is disposed between the guard and the shaving aid member wherein the shaving aid member is located rearward of the razor head and is supported to swing with respect to the razor head about a second pivot axis, and wherein the second pivot axis of the shaving aid member is closer to the guard than the first pivot axis of the razor head.

2. The razor according to claim 1, wherein the shaving aid member is swingable between the initial position and the end position.

3. The razor according to claim 2, wherein the shaving aid member is supported to be swingable with respect to the razor head about an axis extending along an extending direction of a cutting edge of the blade body.

4. The razor according to claim 3, wherein the shaving aid member includes a shaving aid and a base member on which the shaving aid is mounted, the base member including arm portions provided on both sides of the razor head, and the base member being supported by the razor head with the arm portions.

5. The razor according to claim 1, wherein the razor head includes an assembly member formed by a blade base and a top plate, wherein the blade body is provided between the blade base and the top plate, and the blade base is provided with a guard, which faces a cutting edge of the blade body.

6. The razor according to claim 5, wherein the shaving aid member is arranged on the assembly member so as to be located opposite to the guard.

7. The razor according to claim 6, wherein the blade body is exposed outward from the assembly member, and wherein, when the shaving aid member is arranged at the initial position, the shaving aid of the shaving aid member protrudes outward from a skin contact surface, which connects the guard and the top plate to each other.

8. The razor according to claim 1, wherein the elastic body is a leaf spring provided integrally with the shaving aid member, and the leaf spring is supported by the razor head to urge the shaving aid member toward the initial position.

9. The razor according to claim 8, further comprising arm portions that protrude from both sides of a base member formed in the shaving aid member, wherein the leaf spring is provided integrally with the arm portions.

10. The razor according to claim 1, wherein the second pivot axis of the shaving aid member is at the back of a skin contact surface.

* * * * *